US012768224B1

(12) United States Patent
Taylor, Jr. et al.

(10) Patent No.: US 12,768,224 B1
(45) Date of Patent: Oct. 20, 2026

(54) SINGLE TRIP SIDETRACKING SYSTEM AND METHOD

(71) Applicant: WEATHERFORD TECHNOLOGY HOLDINGS, LLC, Houston, TX (US)

(72) Inventors: James H. Taylor, Jr., Houston, TX (US); Ronald G. Barker, New Braunfels, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 19/226,291

(22) Filed: Jun. 3, 2025

Related U.S. Application Data

(60) Provisional application No. 63/806,485, filed on May 15, 2025.

(51) Int. Cl.
*E21B 7/06* (2006.01)
*E21B 23/06* (2006.01)
*E21B 33/13* (2006.01)

(52) U.S. Cl.
CPC ..... *E21B 7/061* (2013.01); *E21B 23/06* (2013.01); *E21B 33/13* (2013.01)

(58) Field of Classification Search
CPC . E21B 29/06; E21B 7/061; E21B 7/06; E21B 33/13
See application file for complete search history.

(56) References Cited

U.S. PATENT DOCUMENTS

| | | | | |
|---|---|---|---|---|
| 5,193,620 | A * | 3/1993 | Braddick | E21B 33/1292 175/81 |
| 9,151,136 | B2 | 10/2015 | Ervin | |
| 9,206,648 | B2 | 12/2015 | Dewey et al. | |
| 9,695,639 | B2 | 7/2017 | Vincent et al. | |
| 10,724,322 | B2 | 7/2020 | Taylor, Jr. et al. | |
| 11,401,763 | B2 | 8/2022 | Al-Mousa et al. | |
| 12,018,565 | B2 | 6/2024 | Al-Mousa et al. | |
| 2005/0194188 | A1* | 9/2005 | Glaser | E21B 23/12 166/313 |
| 2013/0213654 | A1 | 8/2013 | Dewey et al. | |
| 2013/0277051 | A1* | 10/2013 | Vlasko | E21B 33/13 166/278 |
| 2018/0223614 | A1* | 8/2018 | Hern | E21B 23/04 |
| 2021/0246750 | A1* | 8/2021 | MacNeil | E21B 7/061 |
| 2023/0105473 | A1* | 4/2023 | Alzaki | E21B 7/061 175/62 |
| 2023/0272672 | A1 | 8/2023 | Al-Mousa et al. | |
| 2023/0383604 | A1* | 11/2023 | Al-Mousa | E21B 7/061 |
| 2024/0068312 | A1 | 2/2024 | Al-Mousa | |
| 2024/0301754 | A1 | 9/2024 | Al-Mousa et al. | |
| 2025/0003292 | A1* | 1/2025 | Pray | E21B 7/061 |
| 2025/0122773 | A1* | 4/2025 | Nguyen | E21B 17/06 |

* cited by examiner

*Primary Examiner* — Kristyn A Hall
(74) *Attorney, Agent, or Firm* — Smith IP Services, P.C.

(57) ABSTRACT

A method of drilling a lateral wellbore from a parent wellbore can include deploying a bottom hole assembly into the parent wellbore, the bottom hole assembly comprising a whipstock, an anchor and a bit, flowing cement into the parent wellbore, and then setting the anchor in the parent wellbore. A method of sidetracking can include, in a single trip of a tubular string into a wellbore: flowing cement into the wellbore, and then setting an anchor in the wellbore. Another method can include setting a packer in the wellbore after setting the anchor.

20 Claims, 13 Drawing Sheets

SINGLE TRIP SIDETRACKING SYSTEM AND METHOD

CROSS-REFERENCE TO RELATED APPLICATION

The present application claims the benefit of the filing date of U.S. provisional application No. 63/806,485, filed on 15 May 2025. The entire disclosure of the prior application is incorporated herein by this reference for all purposes.

BACKGROUND

This disclosure relates generally to equipment utilized and operations performed in conjunction with a subterranean well and, in an example described below, more particularly provides for drilling a sidetracked wellbore in a single trip.

Sidetracking is a technique whereby a lateral wellbore is drilled outward from a parent wellbore. The lateral wellbore may be drilled to bypass an obstruction in the parent wellbore, to expose the lateral wellbore to a productive zone, or for other purposes.

It will, therefore, be readily appreciated that improvements are continually needed in the art of sidetracking in wells. The present disclosure provides such improvements, which may be used with a wide variety of different well configurations and situations.

DETAILED DESCRIPTION

Figure 1:
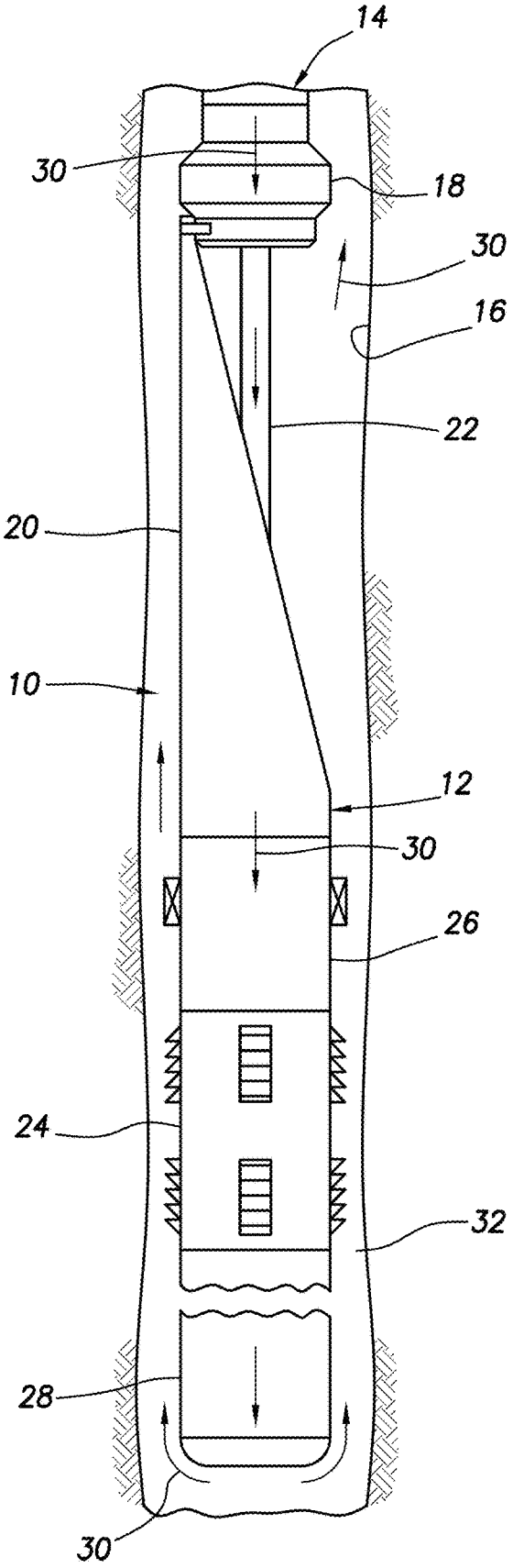
FIG. 1 is a representative partially cross-sectional view of an example of a well system and associated method which can embody principles of this disclosure.

Representatively illustrated in FIG. 1 is a sidetracking system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a bottom hole assembly 12 is connected at a distal end of a tubular string 14 (such as, a drill string) deployed into a wellbore 16. The bottom hole assembly 12 includes a bit 18 releasably attached to a whipstock 20. A flow tube 22 provides a conduit for fluid flow between the bit 18 and the bottom hole assembly 12 downhole of the whipstock 20.

The bottom hole assembly 12 also includes an anchor 24 for securing the bottom hole assembly 12 in the wellbore 16. In this example, the bottom hole assembly 12 further includes a packer 26 and a float shoe 28. The packer 26 is connected between the whipstock 20 and the anchor 24, and the float shoe 28 is connected downhole of the anchor. In other examples, the packer 26 or float shoe 28 may not be used.

During and after deployment of the tubular string 14 into the wellbore 16, fluid 30 can be circulated through the tubular string 14, discharged from the float shoe 28 or downhole end of the bottom hole assembly 12, and returned to surface via an annulus 32 formed between the tubular string and the wellbore.

Figure 2:
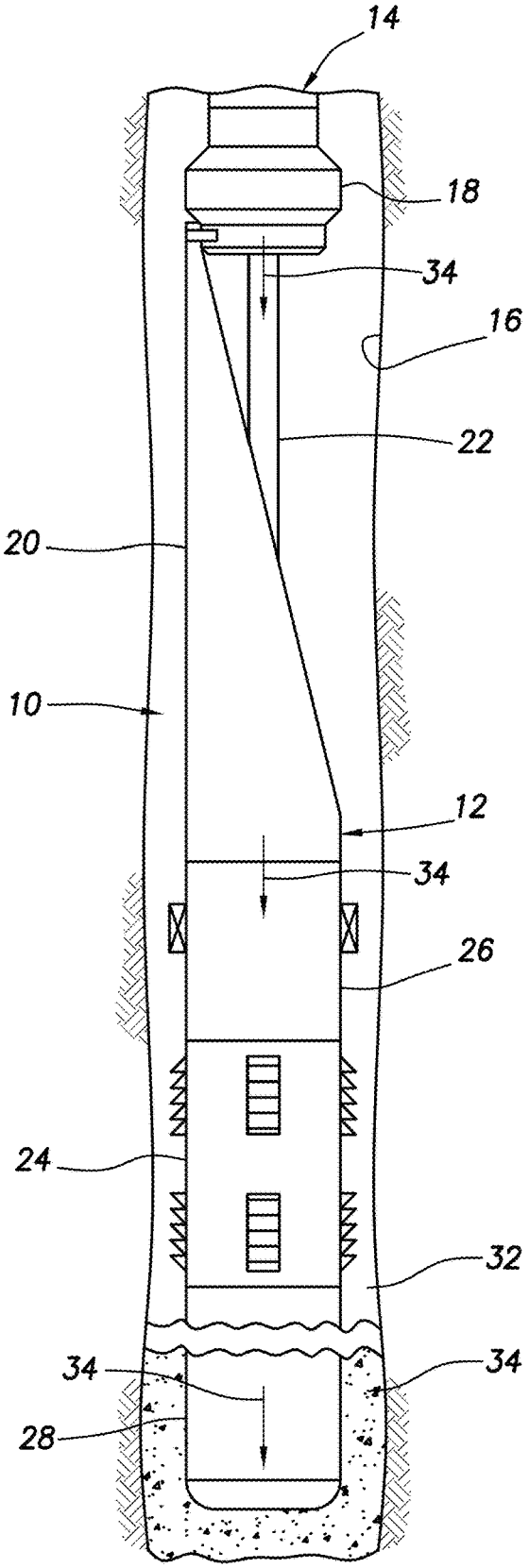
FIG. 2 is a representative partially cross-sectional view of the well system, in which an example of a bottom hole assembly is cemented in a wellbore.

Referring additionally now to FIG. 2, a partially cross-sectional view of the sidetracking system 10 and method is representatively illustrated. In this view, cement 34 is circulated through the tubular string 14 and discharged from the float shoe 28 into the annulus 34 and the wellbore 16 downhole of the bottom hole assembly 12. In some examples, the cement 34 may extend to an uphole end of the whipstock 20.

Figure 3:
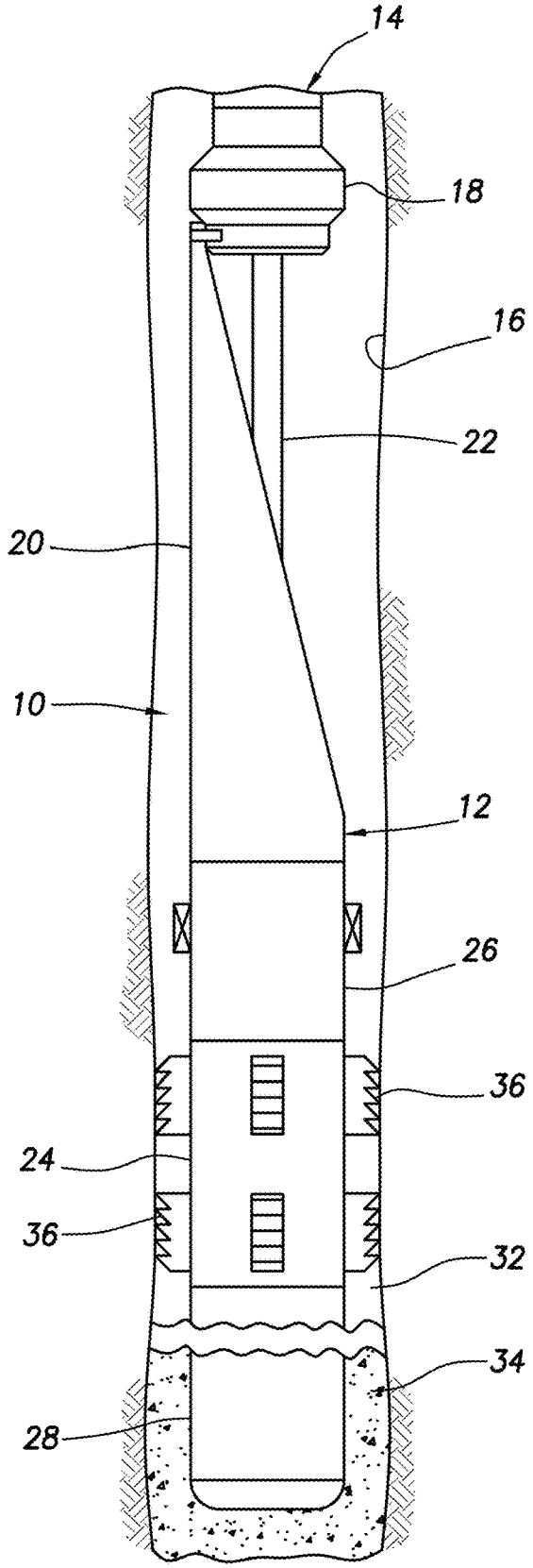
FIG. 3 is a representative partially cross-sectional view of the well system, in which an anchor of the bottom hole assembly is set.

Referring additionally now to FIG. 3, another partially cross-sectional view of the sidetracking system 10 and method is representatively illustrated. In this view, the anchor 24 is set in the wellbore 16 to thereby secure the bottom hole assembly 12 against movement in the wellbore. In this example, the anchor 24 is hydraulically set, so that the whipstock 20 is positioned opposite a desired location for forming a window in the inner wall of the wellbore 16.

To set the anchor 24, a plug (such as, a ball, dart, etc.) is deployed into the tubular string 14, the plug engages a seat in the anchor, and then increased pressure is applied to the tubular string (e.g., using a pump at the surface). In response, slips 36 are extended outwardly into gripping engagement with the wall of the wellbore 16 by a hydraulic actuator of the anchor 24. Other techniques for setting the anchor 24 (such as, by manipulation of the tubular string 14) may be used in other examples.

Figure 4:
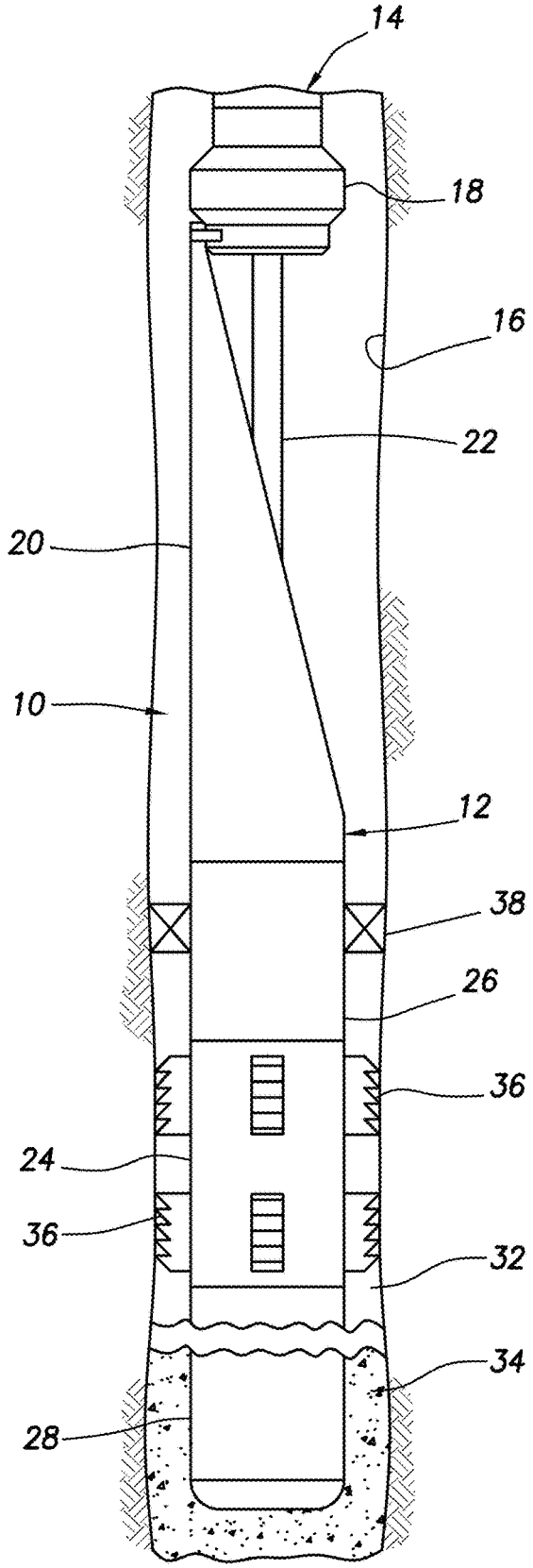
FIG. 4 is a representative partially cross-sectional view of the well system, in which a packer of the bottom hole assembly is set.

Referring additionally now to FIG. 4, another partially cross-sectional view of the sidetracking system 10 and method is representatively illustrated. In this view, the packer 26 is set in the wellbore 16 to thereby block flow through the annulus 32. In this example, the packer 26 is compression set after the anchor 24 is set.

To set the packer 26, weight of the tubular string 14 is applied to the packer by slacking off on the tubular string at the surface. In response, an annular seal element 38 extends radially outward into sealing engagement with the wall of the wellbore 16. Other techniques for setting the packer 26 (such as, using a hydraulic actuator of the packer) may be used in other examples.

Figure 5:
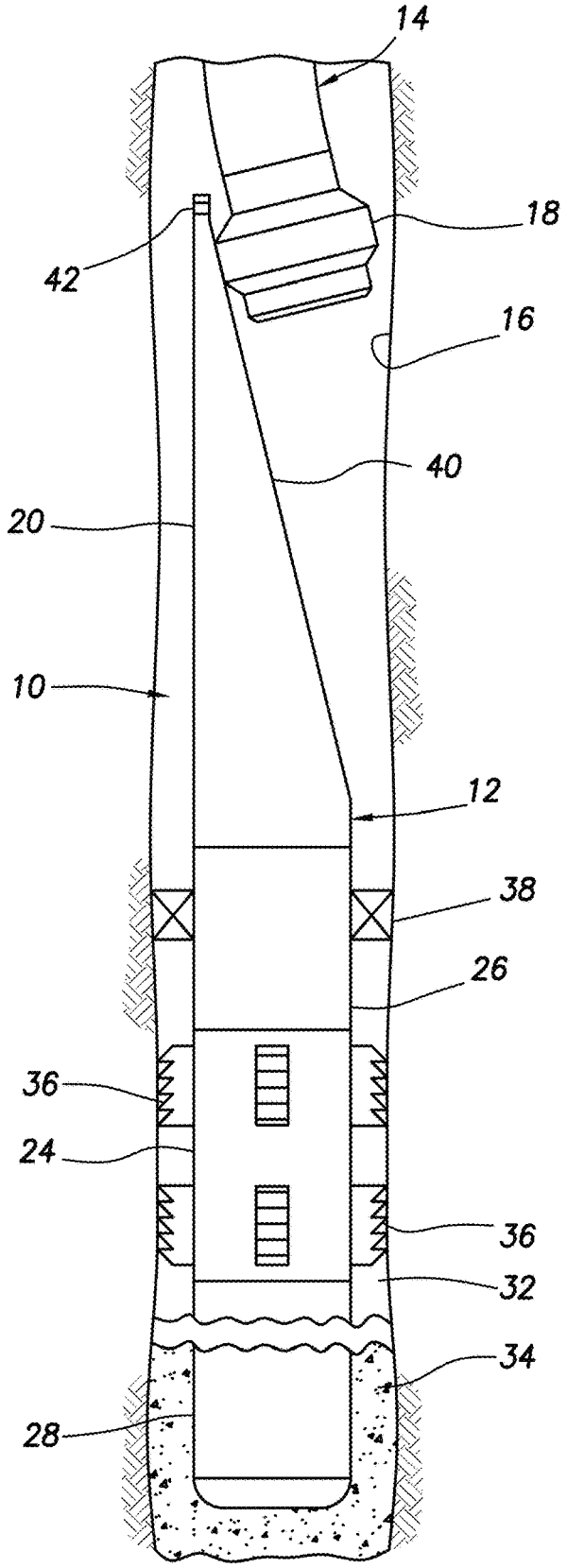
FIG. 5 is a representative partially cross-sectional view of the well system, in which a bit of the bottom hole assembly is released from a whipstock.

Referring additionally now to FIG. 5, another partially cross-sectional view of the sidetracking system 10 and method is representatively illustrated. In this view, the bit 18 (and the remainder of the tubular string 14) is detached from the whipstock 20. The bit 18 can now be displaced along an inclined deflector surface 40 of the whipstock 20.

In this example, the bit 18 is initially releasably secured at an uphole end of the whipstock 20 using, for example, a shear bolt 42 or other releasable device or fastener. The shear bolt 42 can be sheared by pulling the tubular string 14 uphole after the anchor 24 is set. This will also disconnect the tube 22 from the bit 18.

As the bit 18 is displaced along the deflector surface 40 in a downhole direction, the bit is deflected laterally into contact with the wall of the wellbore 16. Preferably, the bit 18 is designed to effectively cut into the wall of the wellbore 16 from a partially lateral direction.

Figure 6:
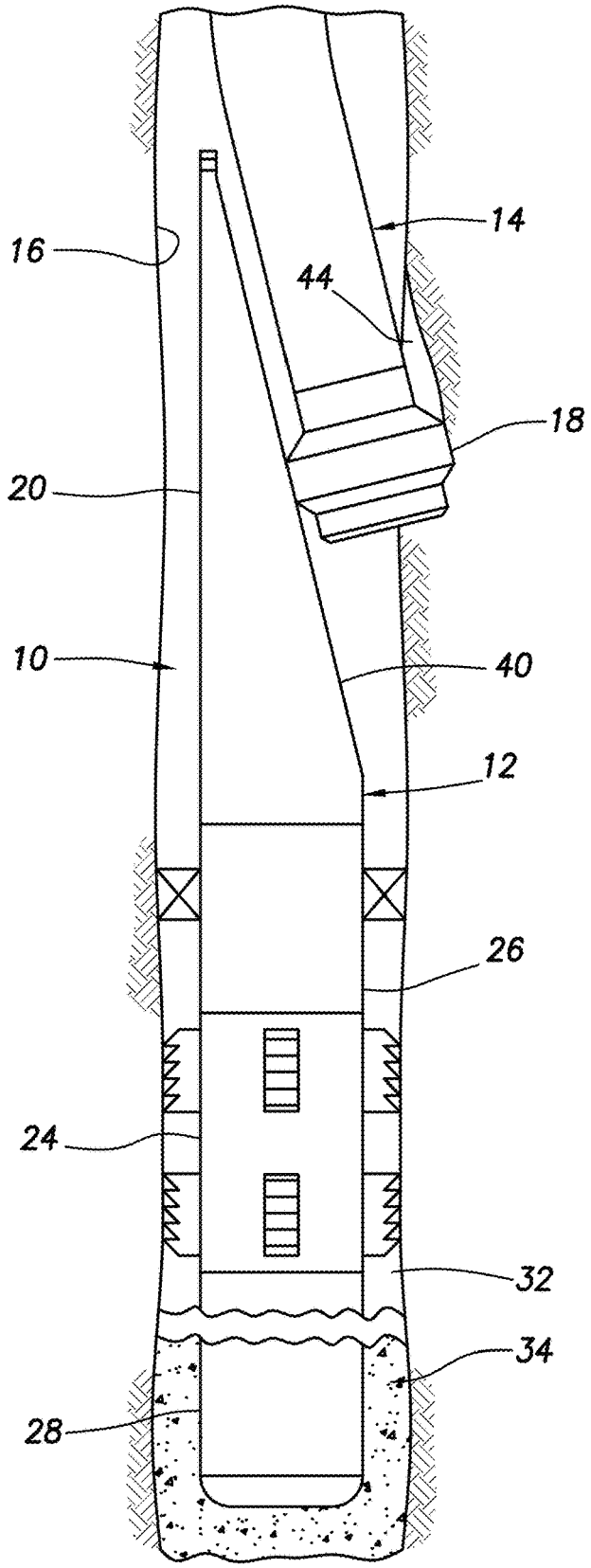
FIG. 6 is a representative partially cross-sectional view of the well system, in which a window is drilled in a wall of the wellbore.

Referring additionally now to FIG. 6, another partially cross-sectional view of the sidetracking system 10 and method is representatively illustrated. In this view, a window 44 is being formed in the inner wall of the wellbore 16. The window 44 is lengthened as the bit 18 displaces in the downhole direction along the deflector surface 40.

Figure 7:
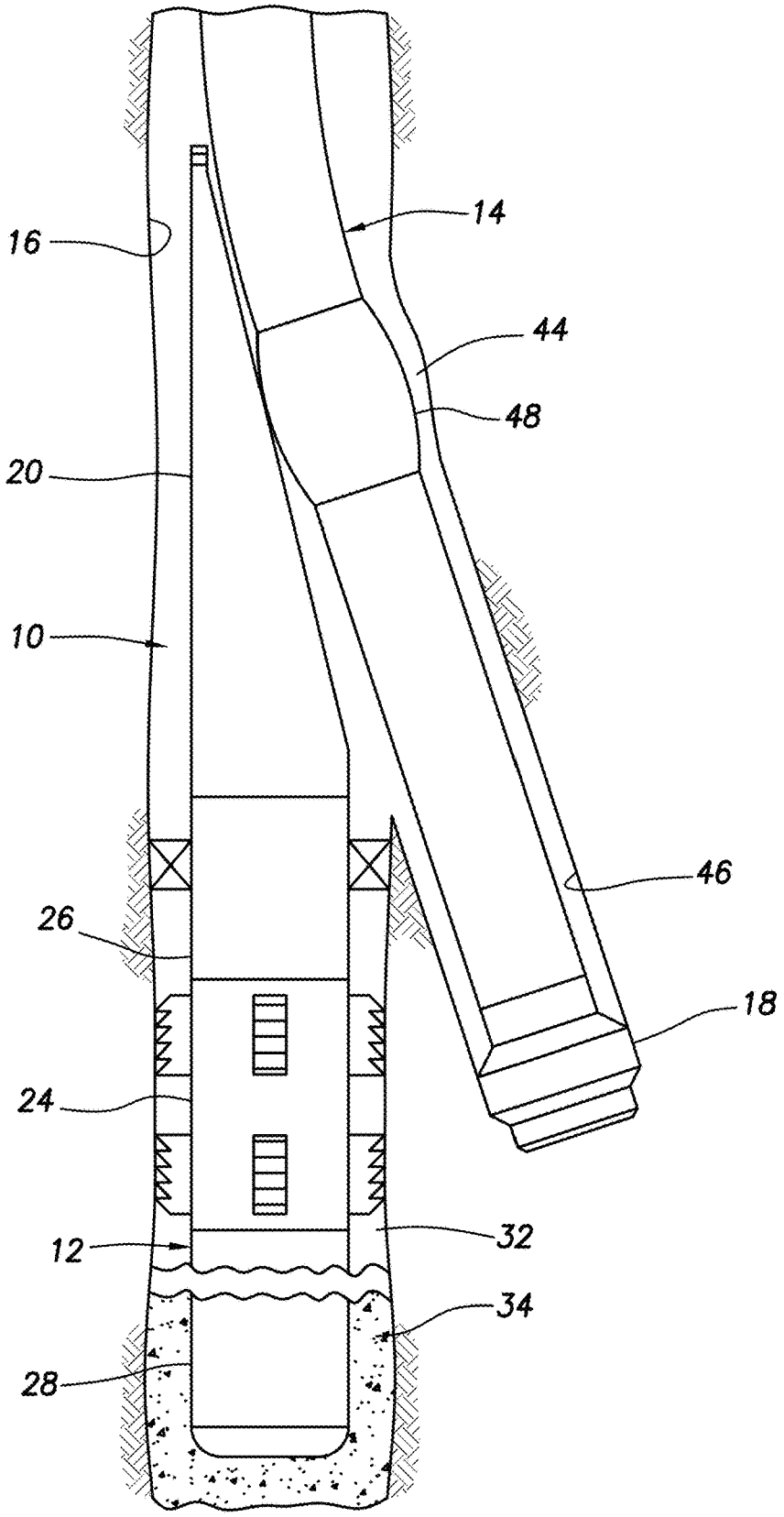
FIG. 7 is a representative partially cross-sectional view of the well system, in which a lateral wellbore is drilled outward from the window.

Referring additionally now to FIG. 7, another partially cross-sectional view of the sidetracking system 10 and method is representatively illustrated. In this view, a branch or lateral wellbore 46 is being drilled outward from the window 44 using the bit 18 and the tubular string 14.

Preferably, the bit 18 is designed to drill the wellbore 46 effectively and efficiently after the window 44 has been formed. The wellbore 46 can be drilled any practical desired distance outward from the wellbore 16. In this manner, the window 44 and the lateral wellbore 46 can be formed using the system 10 in only a single trip of the tubular string 14 into the wellbore 16. The tubular string 14 can include additional equipment (such as, a "watermelon" mill 48, a reamer, etc.) to shape or enlarge the window 44 and wellbore 46.

The tubular string 14 may in some examples include directional or steerable drilling equipment, such as, three-dimensional rotary steering or a directional bent housing drilling motor. As another alternative, the directional or steerable drilling equipment may be included in another tubular string deployed after the branch or lateral wellbore 46 is initially drilled using the tubular string 14.

Figure 8:
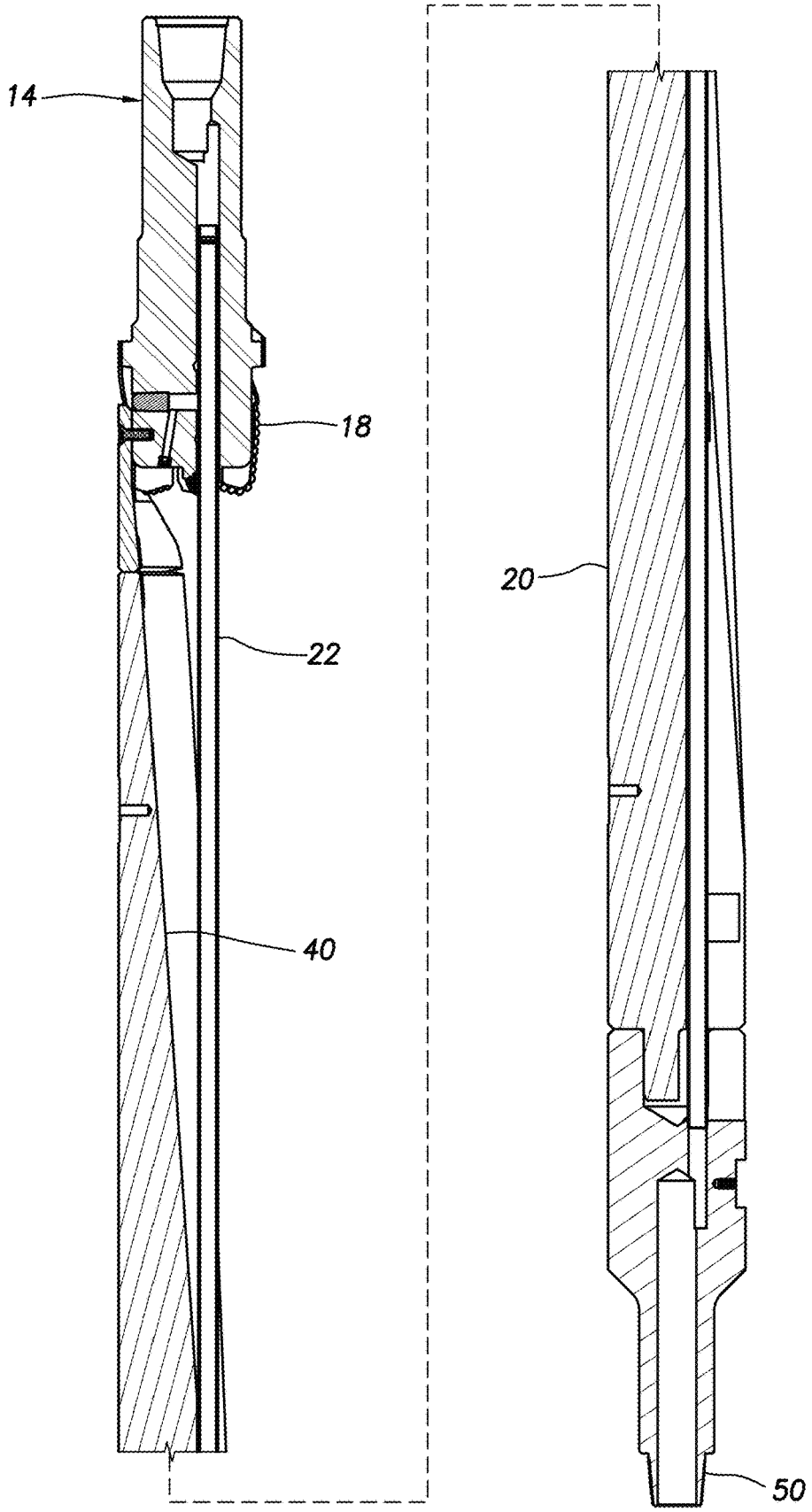
FIG. 8 is a representative side view of an example of the whipstock and bit assembly.

Referring additionally now to FIG. 8, a side view of an example of the bit 18, whipstock 20 and flow tube 22 assembly is representatively illustrated. In this example, a threaded connection 50 is provided at a downhole end of the whipstock 20 for connection of the remainder of the bottom hole assembly 12 (see FIG. 1).

Figure 9:
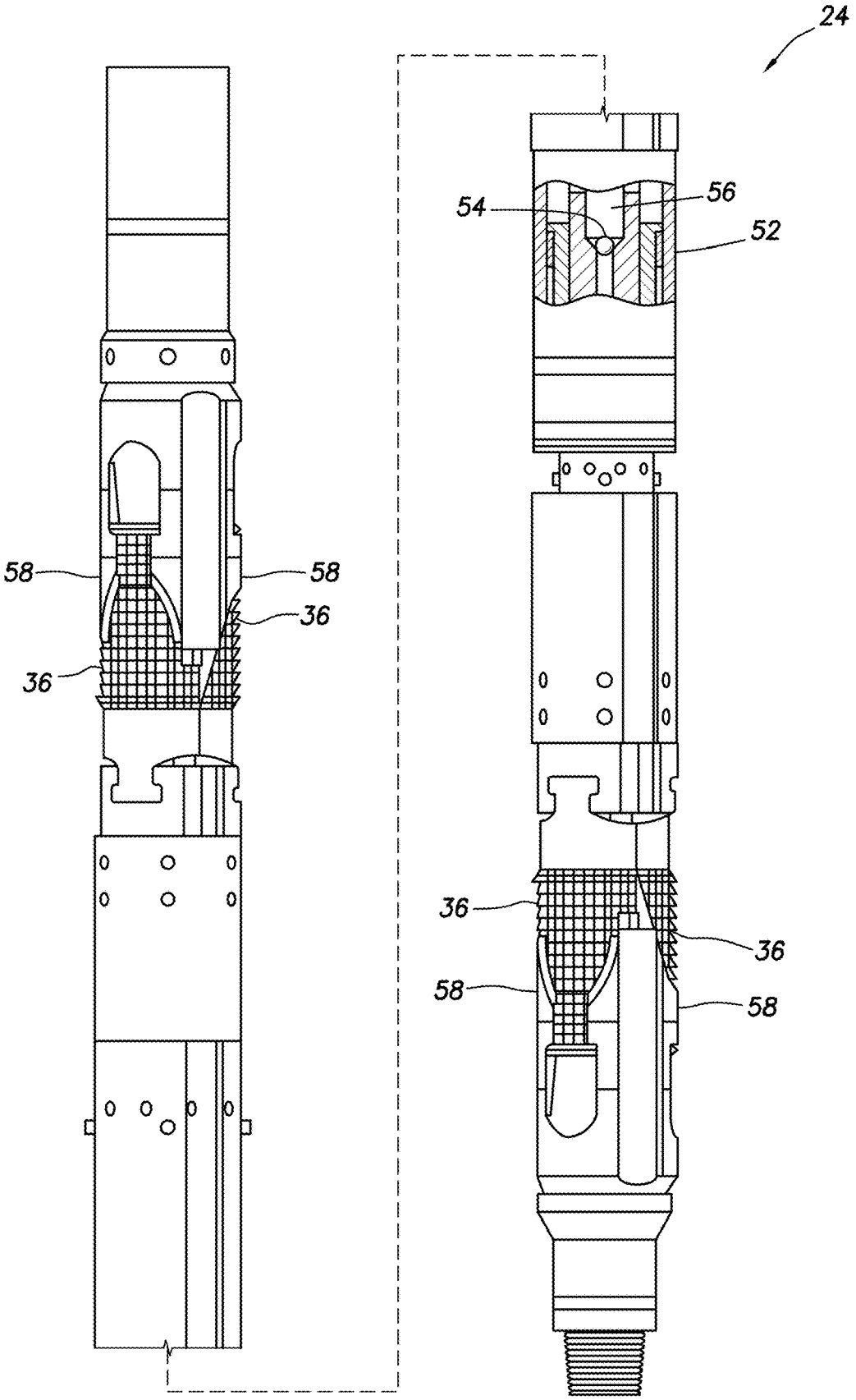
FIG. 9 is a representative cross-sectional view of an example of the anchor.

Referring additionally now to FIG. 9, a cross-sectional view of an example of the anchor 24 is representatively illustrated. In this example, the anchor 24 includes a hydraulic actuator 52 positioned between two sets of the slips 36.

To actuate the actuator 52 and set the anchor 24, a plug 54 (such as, a ball or dart) is deployed into a flow passage 56 extending through the anchor 24 (e.g., by dropping the plug into the tubular string 14 at the surface). The plug 54 in this example engages a seat encircling the flow passage 56 to thereby block flow through the passage.

Pressure in the flow passage 56 is increased (e.g., by applying increased pressure to the tubular string 14 at the surface) to a sufficient level to cause the actuator 52 to displace the two sets of slips 36 in opposite directions. The slips 36 are deflected laterally outward by frusta-conical wedges 58.

Figure 10:
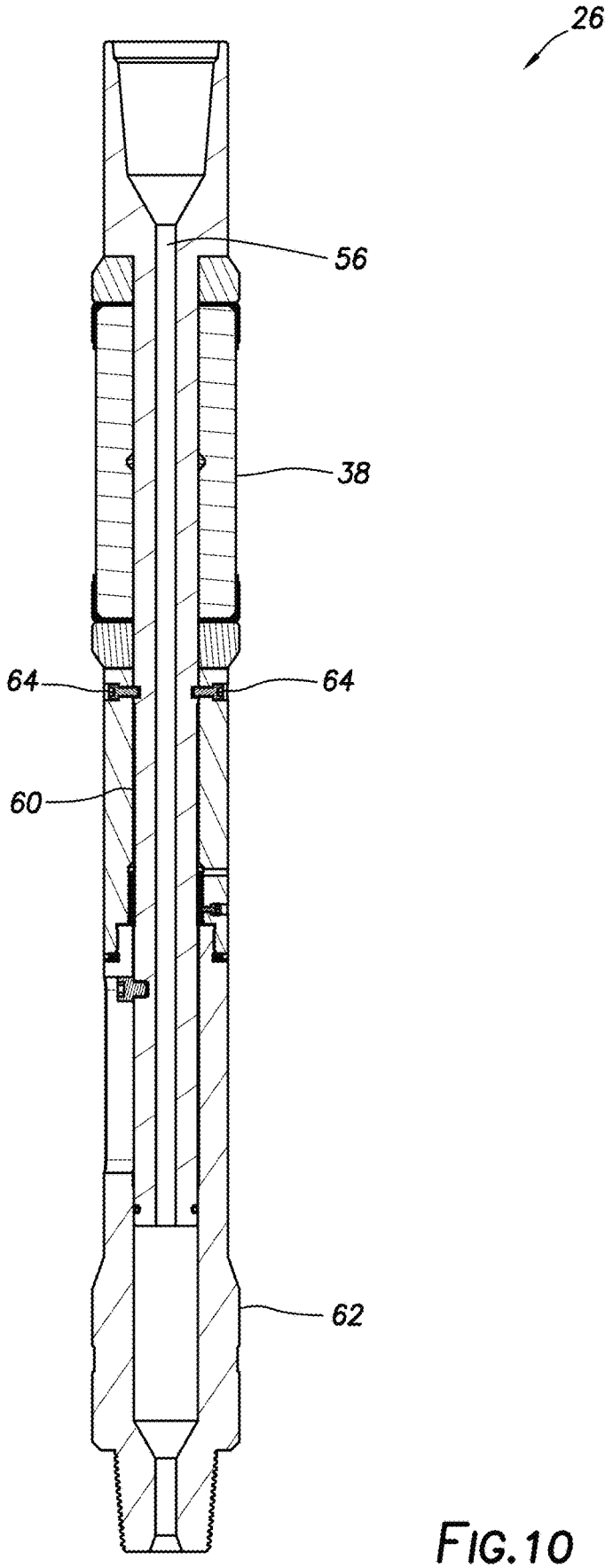
FIG. 10 is a representative cross-sectional view of an example of the packer.

Referring additionally now to FIG. 10, a cross-sectional view of an example of the packer 26 is representatively illustrated. In this example, the packer 26 includes the seal element 38 surrounding a tubular inner mandrel 60 that is telescopingly received in an outer housing 62.

Shear screws 64 initially prevent relative displacement between the mandrel 60 and the housing 62. To set the packer 26, sufficient compressive force is applied to the packer, in order to shear the shear screws 64 and allow the mandrel 60 to be further received in the housing 62. In response, the seal element 38 is longitudinally compressed and extended radially outward.

It will be appreciated that it is not necessary for the packer 26 to be connected in the bottom hole assembly 12 between the whipstock 20 and the anchor 24. In some examples, the anchor 24 can be connected between the whipstock 20 and the packer 26 (e.g., in cases in which the packer is hydraulically set). The bottom hole assembly 12 in other examples can include different tools or components, or combinations of tools or components. Thus, the scope of this disclosure is not limited to any particular configuration or construction of the bottom hole assembly 12.

Figure 11:
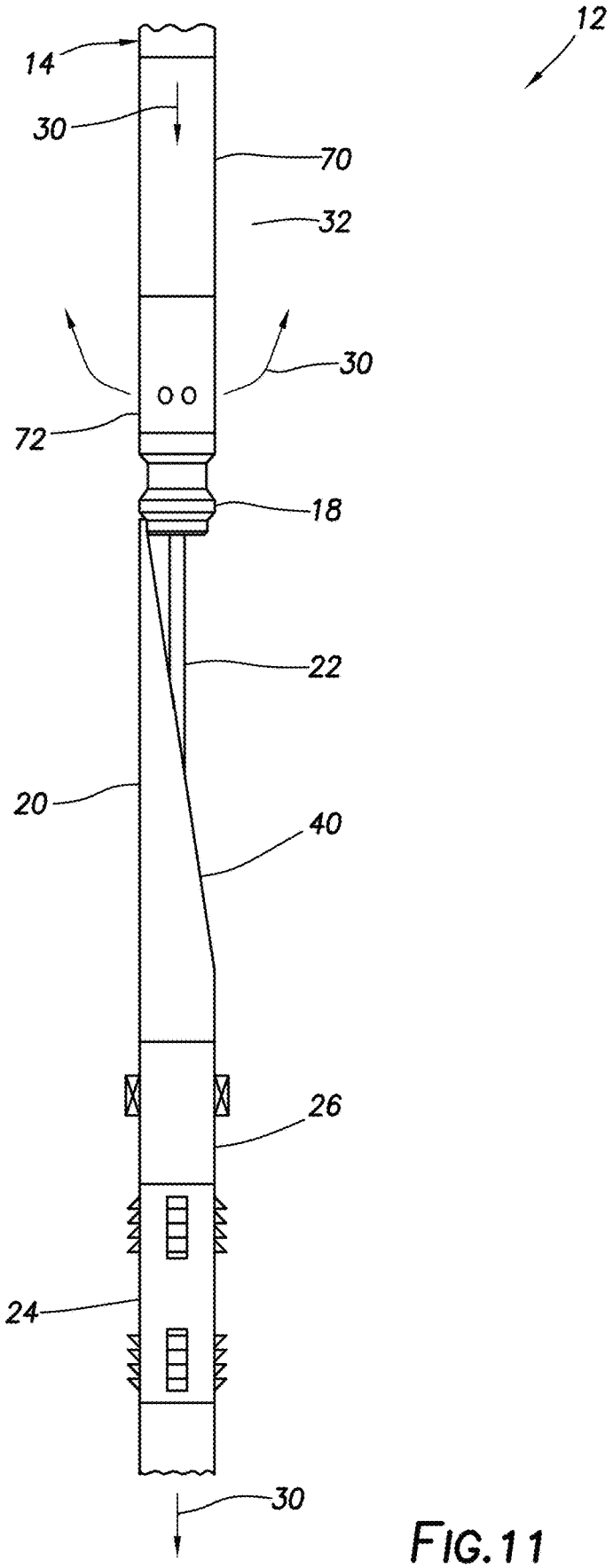
FIG. 11 is a representative side view of another example of the bottom hole assembly.

Referring additionally now to FIG. 11, a representative side view of another example of the bottom hole assembly 12 is depicted. In this example, the bottom hole assembly 12 includes a logging tool 70 and a flow control tool 72 connected uphole of the bit 18. The FIG. 11 bottom hole assembly 12 can be useful for drilling the lateral wellbore 46 in a particular desired azimuthal direction from the parent wellbore 16 (see FIG. 7), for example, to drill a lateral wellbore from an upper side of a horizontal parent wellbore.

The logging tool 70 may be of the type known to those skilled in the art as a measurement-while-drilling (MWD) or logging-while-drilling (LWD) tool. In this example, the logging tool 70 can be used to determine an azimuthal direction of the deflector surface 40 relative to the parent wellbore 16 or the earth.

The flow control tool 72 initially permits flow of the fluid 30 from the interior of the tool to the exterior of the tool (e.g., to the annulus 32). The flow control tool 72 can be selectively closed to prevent fluid communication between the interior and exterior of the tool (for example, when it is desired to set the anchor 24).

Figure 12A:
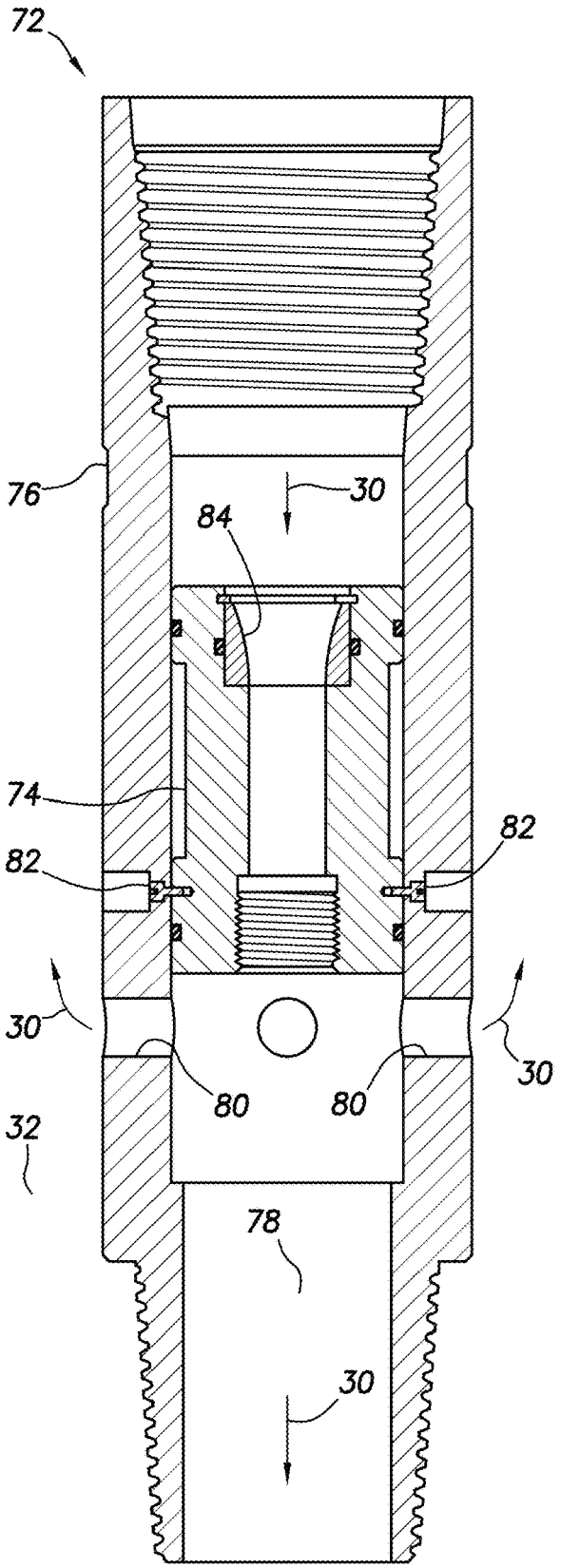
FIGS. 12A & B are representative cross-sectional views of a flow control tool in respective run-in and actuated configurations.

Referring additionally now to FIGS. 12A & B, representative cross-sectional views of the flow control tool 72 in respective run-in and actuated configurations is depicted. In these views, it may be seen that the flow control tool 72 includes a sleeve 74 releasably secured in an outer housing 76. In a run-in configuration depicted in FIG. 12A, the sleeve 74 is in an open position and does not block flow of the fluid 30 between an internal flow passage 78 and the annulus 32 via ports 80 in the housing 76.

The sleeve 74 is releasably secured in the housing 76 with shear screws 82. An orifice 84 in the sleeve 74 restricts flow through the flow passage 78, thereby permitting a pressure differential to be created across the sleeve 74 in response to the flow of the fluid 30.

Figure 12B:
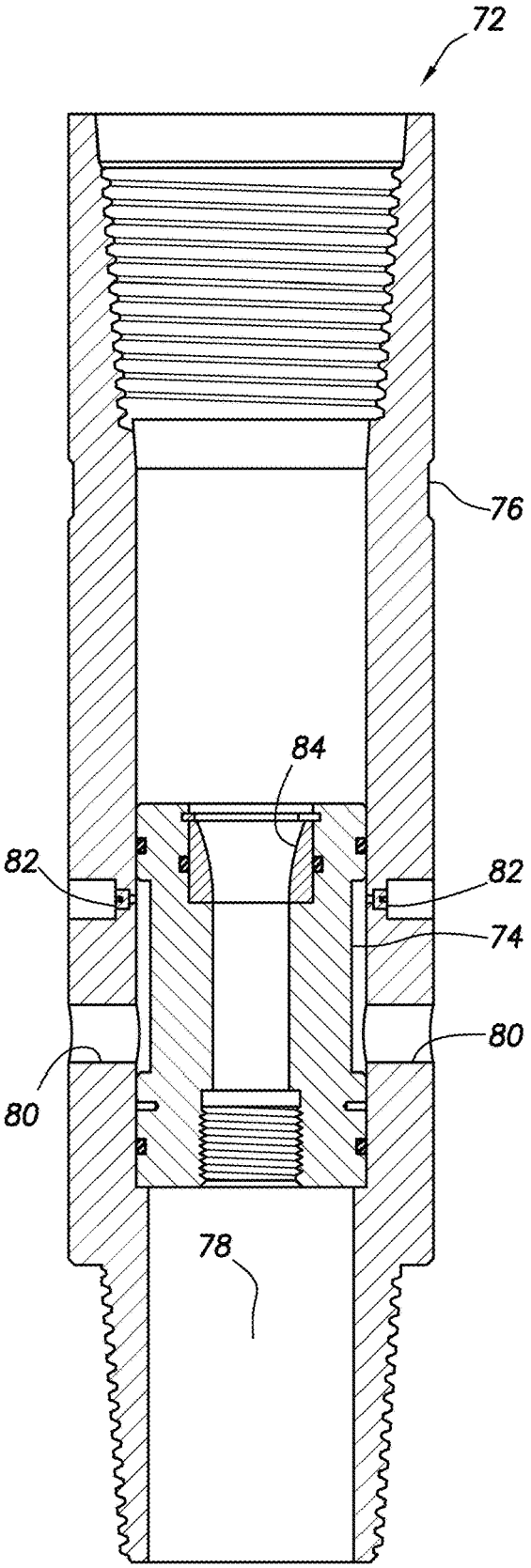

In the FIG. 12B actuated configuration, the flow rate of the fluid 30 through the flow passage 78 has been increased to thereby produce a predetermined pressure differential across the sleeve 74 sufficient to cause the shear screws 82 to shear. The pressure differential has displaced the sleeve 74 to a closed position in which fluid communication between the flow passage 78 and the annulus 32 via the ports 80 is prevented. Fluid flow is still permitted longitudinally through the flow control tool 72 via the flow passage 78.

Figure 13A:
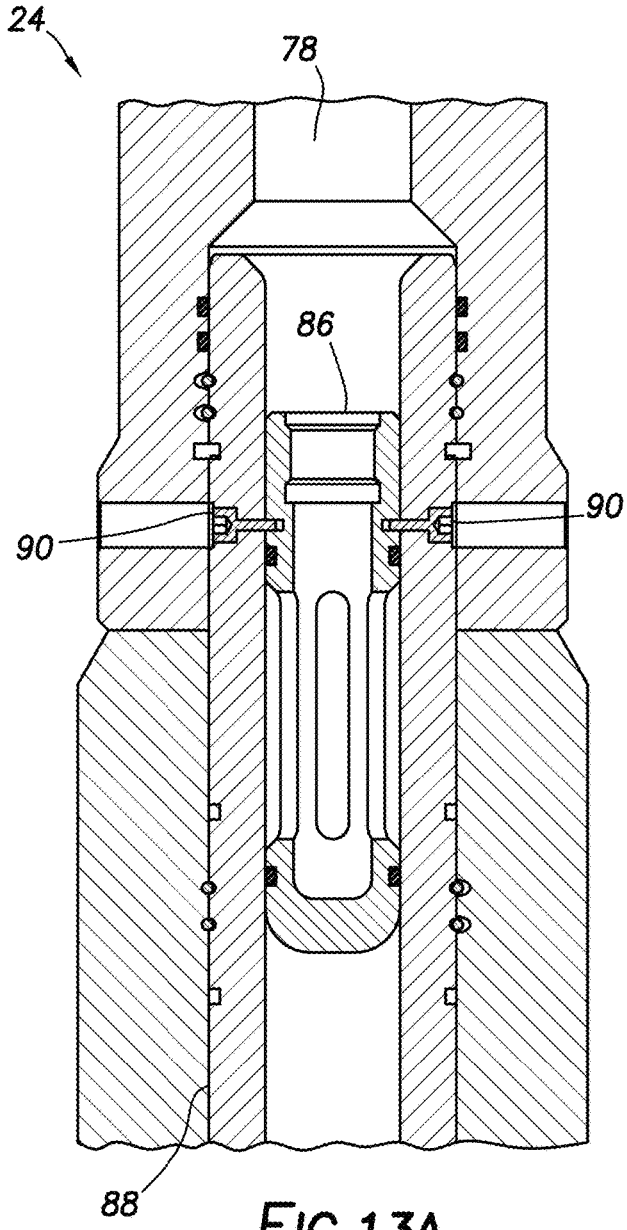
FIGS. 13A & B are representative cross-sectional views of portions of another example of the anchor in respective run-in and actuated configurations.

FIGS. 13A & B are representative cross-sectional views of portions of another example of the anchor 24 in respective run-in and actuated configurations. In the FIG. 13A run-in configuration, a piston 86 is releasably secured in an inner mandrel 88 of the anchor 24. The piston 86 is secured in this position with shear screws 90.

Figure 13B:
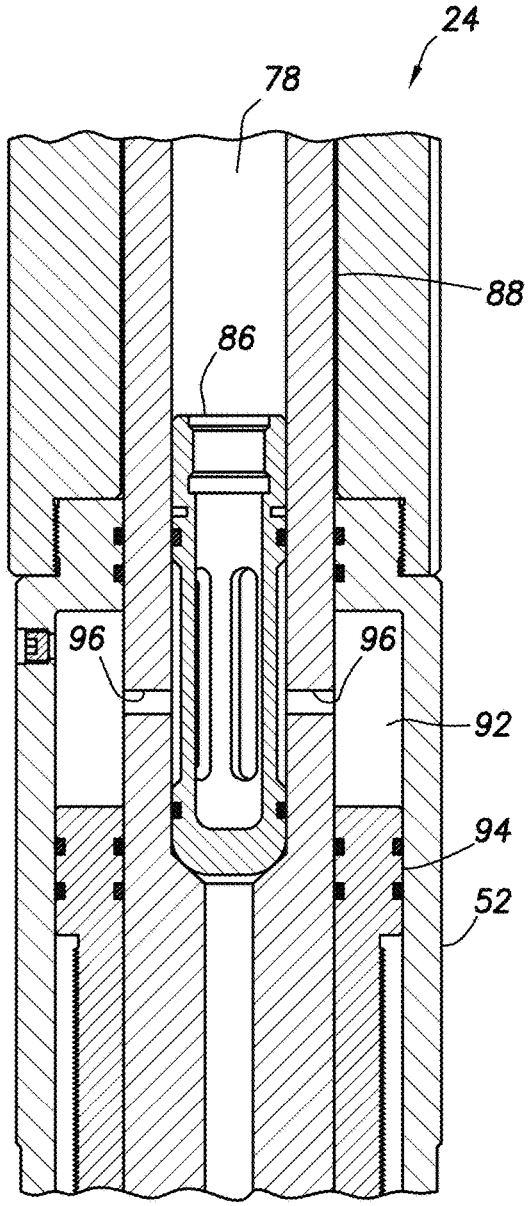

In the FIG. 13B actuated configuration, a predetermined differential pressure has been applied across the piston 86 to shear the shear screws 90. The piston 86 is displaced by the differential pressure to an open position, in which fluid communication is permitted between the flow passage 78 and an annular setting chamber 92 of the hydraulic actuator 52. In the open position of the piston 86, pressure applied to the flow passage 78 is also applied to the chamber 92 and a setting piston 94 of the actuator 52 via ports 96 formed through the inner mandrel 88.

In one example method using the FIG. 11 bottom hole assembly 12, after deploying the bottom hole assembly into the wellbore 16 the logging tool 70 is used to rotationally orient the deflector surface 40 in a desired direction for drilling the lateral wellbore 46. While utilizing the logging tool 70 to orient, rig pumps are operated at no more than a pre-determined maximum rate of flow to prevent an inadvertent shearing of the shear screws 82 and shifting of the sleeve 74 of the flow control tool 72.

Once orientation is determined to be correct, pump flow rates are increased to a pre-determined flow rate to shear the shear screws 82, allowing the sleeve 74 shift and block flow through the ports 80. When the ports 80 are sealed off, pressure will begin to increase in the flow passage 78 (including in the anchor 24).

When the pressure in the flow passage 78 reaches a pre-determined level in the anchor 24, the shear screws 90 will shear and allow the piston 86 to shift to the FIG. 13B open position. In this position, pressure applied to the flow passage 78 is also applied to the chamber 92 and piston 94, thereby setting the anchor slips 36. The pump rate can be increased to further increase pressure in the flow passage 78 and further set the slips 36 into the wall of the wellbore 16.

Once the anchor 24 has been set, the packer 26 may be set and the lateral wellbore 46 can be drilled as described above for the FIG. 1 system 10.

As used herein, the term "parent" wellbore is used to indicate a wellbore from which another wellbore (e.g., a "lateral," "branch" or "sidetrack" wellbore) is drilled. A parent wellbore can be a branch, lateral or sidetrack of another wellbore.

It may now be fully appreciated that the above disclosure provides significant advancements to the art of sidetracking in wells. In an example described above, the system 10 can be used to initiate and drill the lateral wellbore 46 in a single trip of the tubular string 14 into the wellbore 16.

The above disclosure provides to the art a method of drilling a lateral wellbore 46 from a parent wellbore 16. In one example, the method can comprise: deploying a bottom hole assembly 12 into the parent wellbore 16, the bottom hole assembly 12 comprising a whipstock 20, an anchor 24 and a bit 18; flowing cement 34 into the parent wellbore 16; and then setting the anchor 24 in the parent wellbore 16.

The flowing step may include flowing the cement 34 through the bottom hole assembly 12 and into the parent wellbore 16 downhole of the bottom hole assembly 12. The flowing step may include flowing the cement 34 through the bottom hole assembly 12 and into an annulus 32 surrounding the bottom hole assembly 12.

The method may include detaching the bit 18 from the whipstock 20 and then drilling the lateral wellbore 46 with the bit 18.

The deploying, flowing and setting steps may be performed in a single trip of a tubular string 14 into the parent wellbore 16.

In the deploying step, the bottom hole assembly 12 may include a packer 26. The method may include setting the packer 26 after the anchor 24 setting. The packer 26 setting may include applying compression to the bottom hole assembly 12.

The anchor 24 setting may include applying increased pressure in a tubular string 14. The method may include deploying a plug 54 into the tubular string 14 prior to the step of applying increased pressure.

Another method of sidetracking in a subterranean well is described herein. In one example, the method can include: connecting a bottom hole assembly 12 in a tubular string 14, the bottom hole assembly 12 comprising a whipstock 20, an anchor 24 and a bit 18; and in a single trip of the tubular string 14 into a wellbore 16: rotationally orienting a deflector surface 40 of the whipstock toward a desired direction; flowing cement 34 into the wellbore 16; and then setting the anchor 24 in the wellbore 16.

The orienting step may include increasing a flow rate of fluid 30 through a flow control tool 72 connected uphole of the bit 18, thereby blocking fluid communication in the flow control tool 72 between a flow passage 78 extending longitudinally through the flow control tool 72 and an annulus 32 surrounding the bottom hole assembly 12.

The flowing step may include flowing the cement 34 through the bottom hole assembly 12 and into the parent wellbore 16 downhole of the bottom hole assembly 12 and/or into an annulus 32 surrounding the bottom hole assembly 12. The method may include detaching the bit 18 from the whipstock 20 and then drilling a lateral wellbore 46 with the bit 18.

In the deploying step, the bottom hole assembly 12 may include a packer 26, and the method may include setting the packer 26 after the anchor 24 setting. The anchor 24 setting may applying increased pressure in the tubular string 14. The method may include deploying a plug 54 into the tubular string 14 prior to the step of applying increased pressure.

In another method of sidetracking described herein, the method comprises: connecting a bottom hole assembly 12 in a tubular string 14, the bottom hole assembly 12 comprising a whipstock 20, an anchor 24, a packer 26 and a bit 18; and in a single trip of the tubular string 14 into a wellbore 16: flowing cement 34 into the wellbore 16; then setting the anchor 24 in the wellbore 16; and then setting the packer 26 in the wellbore 16.

A sidetracking system 10 for use with a subterranean well is disclosed herein. In one example, the system 10 can comprise: a bit 18 configured for connection in a tubular string 14; a whipstock 20 releasably connected to the bit 18; a flow tube 22 that provides fluid communication between the bit 18 and the whipstock 20; and an anchor 24 configured to secure the whipstock 20 in a wellbore 16 in response to a pressure increase in a flow passage 78 in the anchor 24.

The sidetracking system 10 may include a packer 26 configured to seal off an annulus 34 surrounding the packer 26. The packer 26 may be configured to set in response to a compressive force applied to the packer 26. The packer 26 may be connected between the whipstock 20 and the anchor 24.

The sidetracking system 10 may include a flow control tool 72 connected uphole of the anchor 24, the flow control tool 72 configured to selectively permit and prevent fluid communication between an annulus 34 surrounding the flow control tool 72 and a flow passage 78 extending through the flow control tool 72. The flow control tool 72 may be configured to actuate from an open configuration in which the flow control tool 72 permits fluid communication between the annulus 34 and the flow passage 78 to a closed configuration in which the flow control tool 72 prevents fluid communication between the annulus 34 and the flow passage 78, in response to an increase in a flow rate through the flow passage 78.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of drilling a lateral wellbore from a parent wellbore, the method comprising:

deploying a bottom hole assembly into the parent wellbore, the bottom hole assembly comprising a whipstock, an anchor, a float shoe and a bit;

flowing cement into the parent wellbore, in which the cement is discharged from the float shoe; and then setting the anchor in the parent wellbore.

2. The method of claim 1, in which the flowing comprises flowing the cement through the bottom hole assembly and into the parent wellbore downhole of the bottom hole assembly.

3. The method of claim 1, in which the flowing comprises flowing the cement through the bottom hole assembly and into an annulus surrounding the bottom hole assembly.

4. The method of claim 1, further comprising detaching the bit from the whipstock and then drilling the lateral wellbore with the bit.

5. The method of claim 1, in which the deploying, flowing and setting are performed in a single trip of a tubular string into the parent wellbore.

6. The method of claim 1, in which in the deploying the bottom hole assembly comprises a packer, and further comprising setting the packer after the anchor setting.

7. The method of claim 6, in which the packer setting comprises applying compression to the bottom hole assembly.

8. The method of claim 1, in which the anchor setting comprises applying increased pressure in a tubular string.

9. The method of claim 8, further comprising deploying a plug into the tubular string prior to the increased pressure applying.

10. A method of sidetracking in a subterranean well, the method comprising:

connecting a bottom hole assembly to a distal end of a tubular string, the bottom hole assembly comprising a whipstock, an anchor, a float shoe and a bit; and in a single trip of the tubular string into a parent wellbore:

rotationally orienting a deflector surface of the whipstock toward a desired direction;

flowing cement into the parent wellbore, in which the cement is discharged from the float shoe; and then setting the anchor in the parent wellbore.

11. The method of claim 10, in which the orienting comprises increasing a flow rate of fluid through a flow control tool connected uphole of the bit, thereby blocking fluid communication in the flow control tool between a flow passage extending longitudinally through the flow control tool and an annulus surrounding the bottom hole assembly.

12. The method of claim 10, in which the flowing comprises flowing the cement through the bottom hole assembly and into the parent wellbore downhole of the bottom hole assembly.

13. The method of claim 10, further comprising detaching the bit from the whipstock and then drilling a lateral wellbore with the bit.

14. The method of claim 10, in which in the deploying the bottom hole assembly comprises a packer, and further comprising setting the packer after the anchor setting.

15. The method of claim 10, in which the anchor setting comprises applying increased pressure in the tubular string.

16. A method of sidetracking in a subterranean well, the method comprising:

connecting a bottom hole assembly to a distal end of a tubular string, the bottom hole assembly comprising a whipstock, an anchor, a packer and a bit; and in a single trip of the tubular string into a parent wellbore:
flowing cement into the parent wellbore;
then setting the anchor in the parent wellbore; and
then setting the packer in the parent wellbore, in which the packer is compression set after the anchor is set.

17. The method of claim 16, in which the flowing comprises flowing the cement through the bottom hole assembly and into the parent wellbore downhole of the bottom hole assembly.

18. The method of claim 16, in which the flowing comprises flowing the cement through the bottom hole assembly and into an annulus surrounding the bottom hole assembly.

19. The method of claim 16, further comprising detaching the bit from the whipstock and then drilling a lateral wellbore with the bit.

20. The method of claim 16, in which the anchor setting comprises applying increased pressure in the tubular string.

* * * * *